US006779794B2

(12) United States Patent
Hedrick et al.

(10) Patent No.: US 6,779,794 B2
(45) Date of Patent: Aug. 24, 2004

(54) GAMING DEVICE HAVING A CONTAINER-ITEM HOLDER

(75) Inventors: Joseph R. Hedrick, Reno, NV (US); Kehl T. LeSourd, Reno, NV (US); Jean P. Legras, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/966,696

(22) Filed: Sep. 28, 2001

(65) Prior Publication Data

US 2003/0062673 A1 Apr. 3, 2003

(51) Int. Cl.[7] ..... A63F 11/00

(52) U.S. Cl. ..... 273/148 R; 463/47

(58) Field of Search ..... 273/143 R, 148 R, 273/309; D21/325, 326, 332, 333, 369, 385; 248/229.25, 231.71, 311.2, 315, 309.1, 215; 220/757; 206/DIG. 806; 463/46, 47

(56) References Cited

U.S. PATENT DOCUMENTS

| | | | | | |
|---|---|---|---|---|---|
| 4,846,333 | A | * | 7/1989 | Kissick | 194/344 |
| 4,856,744 | A | * | 8/1989 | Frankel | 248/215 |
| 5,020,755 | A | * | 6/1991 | Frankel | 248/215 |
| 5,052,649 | A | * | 10/1991 | Hunnicutt | 248/311.2 |
| 5,143,335 | A | * | 9/1992 | Frankel | 248/215 |
| 5,244,175 | A | * | 9/1993 | Frankel | 248/215 |
| 5,279,452 | A | * | 1/1994 | Huynh | 224/482 |
| 5,400,990 | A | * | 3/1995 | Frankel | 248/215 |
| 5,690,036 | A | * | 11/1997 | Hasegawa | 108/25 |
| 5,797,612 | A | * | 8/1998 | Buccioni | 280/47.26 |
| 5,934,637 | A | * | 8/1999 | Robinson | 248/311.2 |
| 6,003,013 | A | * | 12/1999 | Boushy et al. | 705/10 |
| 6,053,340 | A | * | 4/2000 | Cameron | 211/85.7 |
| 6,116,597 | A | * | 9/2000 | Rowe et al. | 273/143 R |
| 6,161,805 | A | * | 12/2000 | Wells | 248/118 |
| 6,290,229 | B1 | * | 9/2001 | Perez | 273/148 R |
| D450,094 | S | * | 11/2001 | Hedrick et al. | D21/369 |
| D451,148 | S | * | 11/2001 | Hedrick et al. | D21/369 |
| D451,153 | S | * | 11/2001 | Hedrick et al. | D21/385 |
| 6,422,670 | B1 | * | 7/2002 | Hedrick et al. | 312/223.1 |
| 6,446,920 | B1 | * | 9/2002 | Wells et al. | 248/118 |

FOREIGN PATENT DOCUMENTS

| | | | | |
|---|---|---|---|---|
| JP | 10052558 A | * | 2/1998 | A63F/7/02 |
| JP | 2001149606 A | * | 6/2001 | A63F/7/02 |

OTHER PUBLICATIONS

Slot Machine written by Marshall Fey published 1983, 1989, 1991, 1994, 1997.

* cited by examiner

*Primary Examiner*—Jessica Harrison
*Assistant Examiner*—Alex F. R. P. Rada, II
(74) *Attorney, Agent, or Firm*—Bell, Boyd & Lloyd LLC

(57) ABSTRACT

The present invention relates to a container-item holder for a gaming device and a gaming device which removably receives the container-item holder. The container-item holder is inserted within a ledge connected to the gaming device. The container-item holder holds containers and personal items for players while they play games. This type of gaming device provides players with increased convenience and security when playing gaming devices.

12 Claims, 5 Drawing Sheets

GAMING DEVICE HAVING A CONTAINER-ITEM HOLDER

DESCRIPTION

The present invention relates in general to a gaming device having a combined container-item holder.

BACKGROUND OF THE INVENTION

Certain gaming areas or casinos are crowded because certain gaming owners maximize the number of gaming devices in their gaming area, leaving small amounts of space around the device for the player's personal use or to accommodate the player's personal items or belongings.

Gaming establishment owners want players to feel as comfortable and secure as possible while playing the gaming devices. However, the limited space in the gaming area provides little room for players to place or secure their personal items. Players also sometimes carry containers for drinks or tokens, and players either hold the containers or balance the containers on any available surface near the gaming device. Players also generally hold onto their personal items such as bags, purses and fanny packs, placing them on the gaming devices to keep them in their line of site or placing them under their chairs or stools (if provided) to prevent these items from being stolen.

Known gaming devices include drink holders to accommodate the players' drink containers. However, there are no known gaming devices which include a removable device that accommodates both containers and personal items such as bags, purses, coats and umbrellas.

SUMMARY OF THE INVENTION

The present invention includes a container-item holder for a gaming device and a gaming device which is adapted to receive the container-item holder. The container-item holder enables a player to conveniently hold his/her drink and personal items on one holder connected to the gaming device. A player can use the container-item holder to hold a drink, cup or container of tokens while holding one or more items, such as a bag, purse, coat, umbrella, fanny pack, back pack, hat, key chain or other personal item(s).

In one embodiment of the present invention, the gaming device includes a cabinet and a support or ledge, preferably a bolster, connected to the front panel of the cabinet. The bolster functions as an arm rest for players. The bolster includes or defines a holding channel adapted to receive the container-item holder. The channel extends transversely through the bolster.

In another embodiment, the gaming device includes a cabinet and a suitably shaped ledge or support connected to the front panel of the cabinet. In one embodiment, the ledge is comprised of a wedge-shaped block which is rigidly fixed to the front panel. The ledge or support includes a channel for receiving a container-item holder. The channel extends transversally through the ledge or support, forming a cylindrical passageway from the upper surface to the lower surface of the ledge or support.

The container-item holder of the present invention is adopted to be mounted in the gaming device and particularly to the bolster, ledge or other suitable support. In one embodiment, the container-item holder includes a container holding portion or container holder which is connected to an item holding portion or item holder. The container holding portion includes a tubular-shaped body or wall having an upper end and a lower end. Preferably, the upper end of the body has a flange which has a greater circumference than the circumference of the wall.

In one embodiment, the flange secures the container-item holder within channel and prevents the container-item holder from sliding through the bolster or other support channel. Consequently, when the container-item holder is inserted into the channel of the bolster or other support, the flange engages the upper surface of the bolster or other support. The flange supports the weight of the container and any items held by the container-item holder.

In alternative embodiments, instead of or in addition to relying upon the flange, the wall of the container holding portion can screwably engage the support channel or be press fit into the channel. In a press fit engagement, the wall could be approximately equal to or slightly larger in diameter than the diameter of the channel. Press fitting the container holding portion into the channel generates a frictional engagement which supports the weight of the container and items held by the container-item holder.

In one alternative embodiment, the container holding portion has generally tapered walls. In this embodiment, the upper end of the container holding portion has a greater diameter than the lower end of the container holding portion. This tapering provides the support for the container-item holder in the bolster and prevents the container-item holder from sliding through the bolster.

The lower end of the container holding portion includes a base which supports the cups, cans and other containers. The base includes or defines a plurality of holes, cavities or drainage openings which prevent spilled beverage from accumulating inside the container holding portion. The base also defines an opening for receiving the item holding portion.

In one embodiment, the item holding portion is comprised of a hook. The hook includes a relatively straight connecting portion which extends through and into the opening defined by the base of the container holding portion. The hook also includes a securing portion which holds and secures items which are hung on the hook.

To connect the hook to the container holding portion, the connecting portion of the hook is inserted into and extended through the opening in the base of the container holding portion. A retaining ring is mounted in a groove of the hook. This type of fastener enables the hook to freely rotate relative to the base of the container holding portion. It should be appreciated that other suitable fasteners or attachment methods or mechanisms can be used to connect the hook to the container holding portion.

The container-item holder and gaming device of the present invention enables players to hold their drink containers or other containers while holding their personal items at the gaming device where they are playing games. For example, a player can hold a can of soda in the container-item holder, and at the same time the player can hang a purse from the container-item holder. This provides players with an increased level of convenience and provides a more secure gaming environment. The container-item holder of the present invention additionally enables manufacturers of the gaming devices to use a single mechanism to accomplish multiple tasks and reduces overall manufacturing costs.

It is therefore an advantage of the present invention to provide a gaming device having a container-item holder and a container-item holder for the gaming device.

A further advantage of the present invention to provide a gaming device adapted to receive a container-item holder.

Another advantage of the present invention to provide a container-item holder which is adapted to be removably secured to a gaming device.

Other objects, features and advantages of the invention will be apparent from the following detailed disclosure, taken in conjunction with the accompanying sheets of drawings, where in like numerals refer to like parts.

DETAILED DESCRIPTION OF THE INVENTION

Gaming Device

Figure 1:
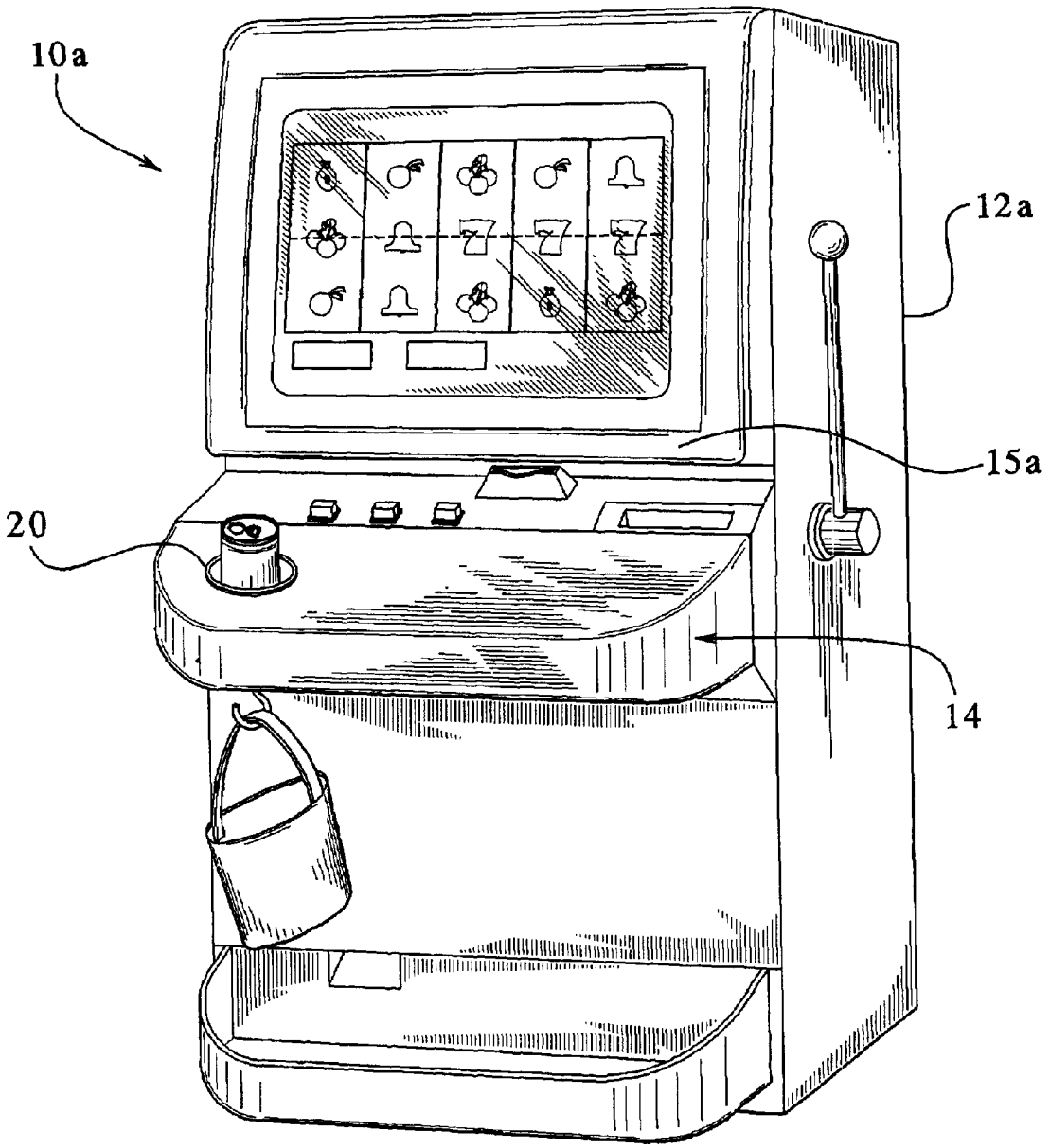
FIG. 1 is a perspective view of the gaming device and container-item holder of one embodiment of the present invention illustrating the container-item holder secured in a bolster, a beverage can in the container holding portion and a purse hanging from the item holding portion.

Referring now to FIG. 1, in one embodiment of the present invention gaming device 10*a* includes a cabinet 12*a* and a support or ledge, preferably a bolster 14, connected to the front panel 15*a* of the cabinet 12*a*. Bolster 14, which players can use as an arm rest or for other purposes, can be permanently, adjustably or removably connected to the cabinet 12. It should also be appreciated that the container-item holder of the present invention could alternatively be attached to a support mounted to the side of a gaming device. The bolster 14 includes or defines a holding channel 16 for a container-item holder which is generally designated by numeral 20. Channel 16 extends transversally through the bolster 14. Preferably, the container-item holder is removably mounted in the channel 16 which facilitates cleansing and replacement of the container-item holder.

Figure 2:
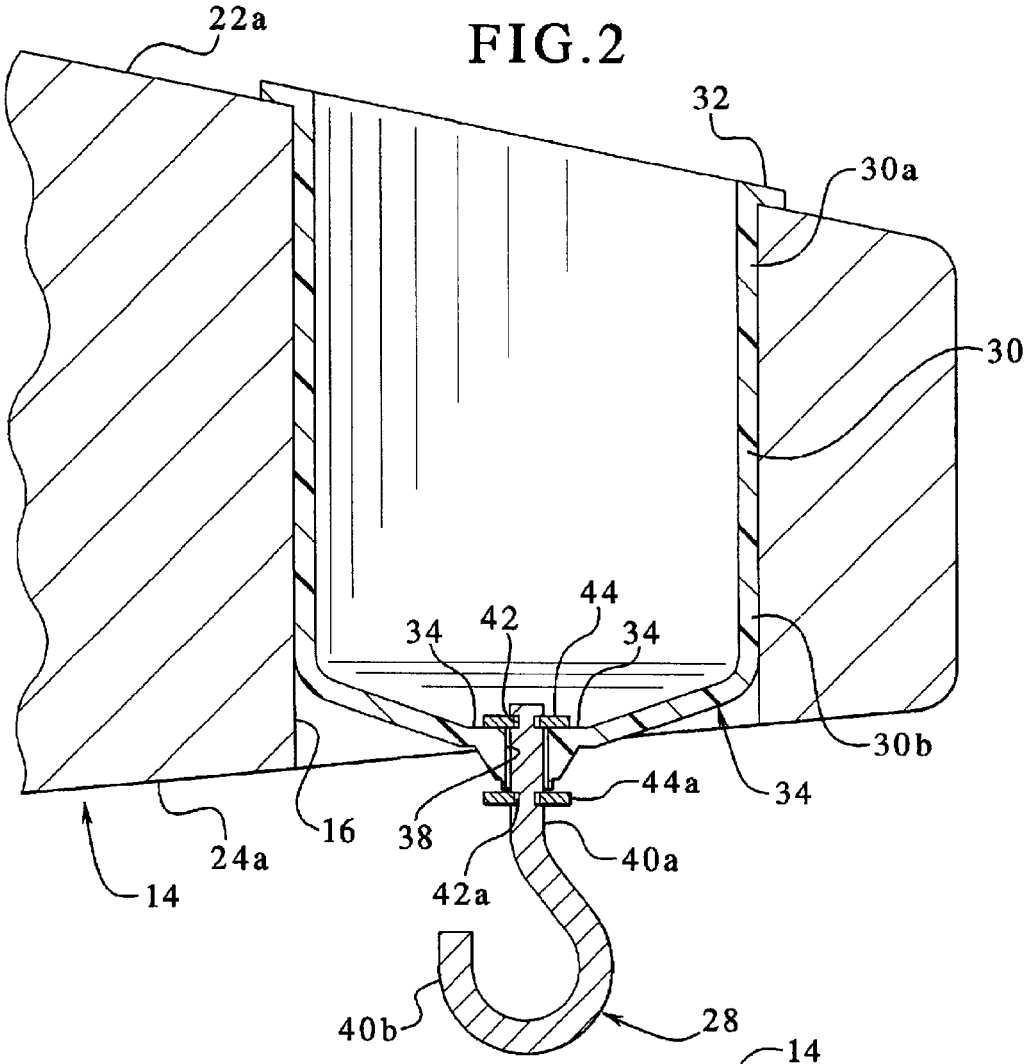
FIG. 2 is a vertical cross-sectional view of the bolster and the container holder and item holder of the container-item holder of FIG. 1.

As illustrated in FIG. 2, bolster 14 includes an upper surface 22*a* and a lower surface 24*a*. In one embodiment, the lower surface is a rigid frame, and the upper surface is a cover or top portion of padding material supported by the frame. The padding material provides patron support, acting as an extending ergonomic cushion used by the patron to make the player more comfortable while playing the gaming device 10*a*. Preferably, the upper surface 22*a* is defined by the top portion of a single padded member constructed of a single integral piece of soft foam, or a natural or synthetic rubber material.

It should be appreciated that the bolster 14 can be constructed of any suitable material including, without limitation, urethane, polyvinyl chloride or polyvinyl acetate. While it is preferred that the padding material is formed as a single integral unit, it should also be appreciated that the padding material can be formed of a plurality of units, of the same or different materials.

Figure 3:
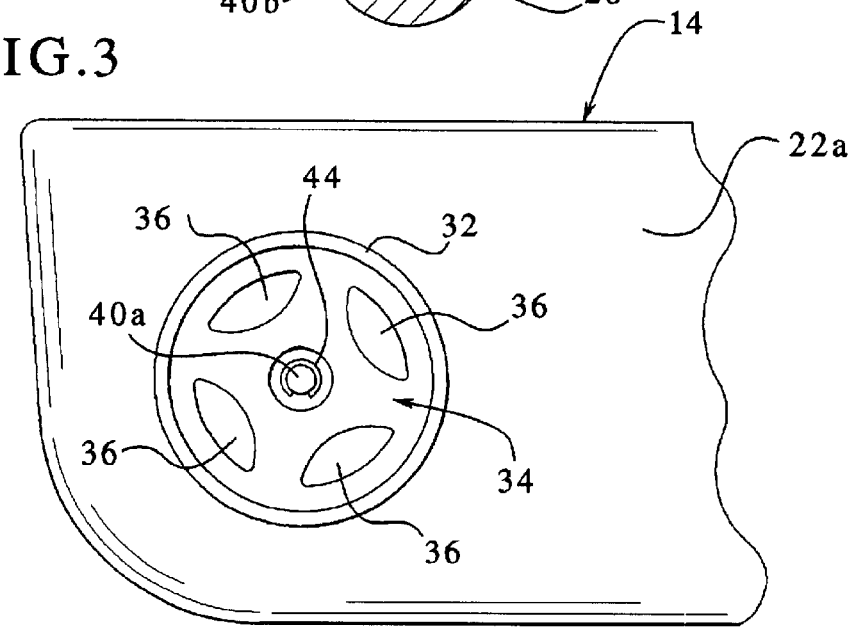
FIG. 3 is a fragmentary top plan view of the bolster and the cup holding portion of FIG. 1.

As further illustrated in FIG. 2, the bolster 14 defines a holding channel 16 for receiving the container-item holder 20 of the present invention. The holding channel 16 has a predetermined circumference and extends vertically between the upper surface 22*a* and the lower surface 24*a* of the bolster 14. In one embodiment, bolster 14 defines the channel 16 in spaced relationship to the rounded edge of the bolster 14 as illustrated in FIGS. 1 and 3. The bolster 14 further defines the holding channel 16 such that it is ergonomically accessible to both right and left handed players. In an alternative embodiment, the bolster defines two or more holding channels, one accessible to right-handed players and the other accessible to left-handed players.

Figure 4:
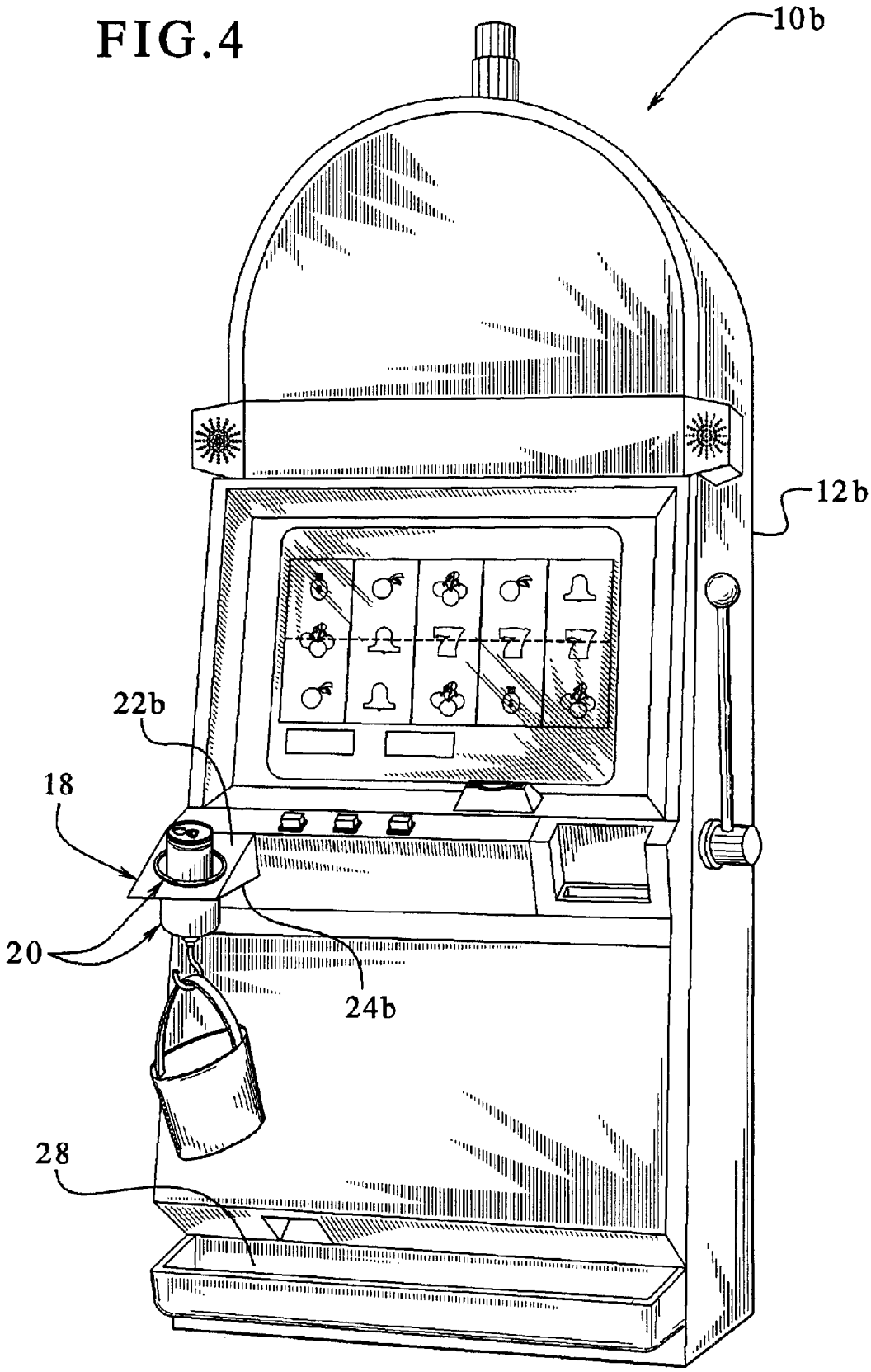
FIG. 4 is a perspective view of the gaming device and container-item holder of one embodiment of the present invention illustrating the container-item holder secured in a support or ledge attached to the front cabinet of the gaming device, a beverage can in the container holding portion and an umbrella hanging from the item holding portion.
Figure 5:
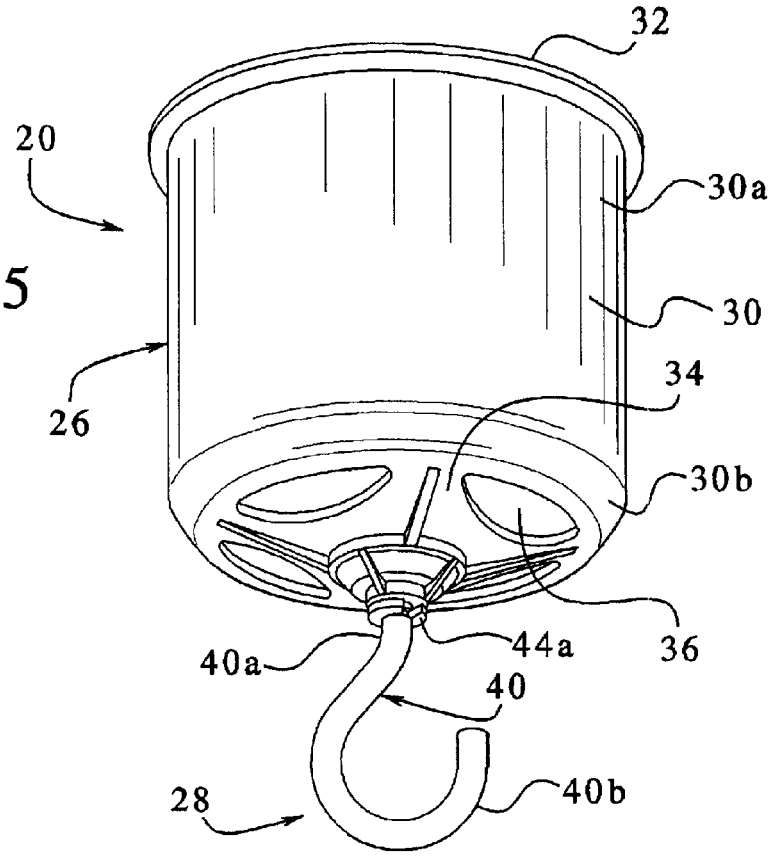
FIG. 5 is a side perspective view of the container holder and item holder of the container-item holder of FIG. 1 shown removed from the bolster.

In another embodiment illustrated in FIG. 4, gaming device 10*b* includes a cabinet 12*b* and a support or ledge 18 connected to the front panel 15*b* of the cabinet. Here, support or ledge 18 is comprised of a wedge-shaped block which is attached to the front panel 15*b*. It should be appreciated that the support could be any suitable shape and size. The support or ledge 18 includes a channel 16*b* for receiving a container-item holder 20. Channel 16*b* extends transversally through the support or ledge 14*b*, forming a cylindrical passageway from the upper surface 22*b* to the lower surface 24*b* of the support or ledge.

It should be appreciated that the support or ledge illustrated in FIG. 4 is merely an example and that the support or ledge can be connected rigidly or otherwise to any side of the cabinet. For example, the support or ledge can be hingedly connected to the cabinet. One or more support members can be connected to the cabinet or the support or ledge for maintaining the support or ledge in a substantially horizontal position when in use. Such a hinged connection can enable a player to fold down the support or ledge when needing to use the container-item holder and to fold up the support or ledge when the player has finished using the container-item holder. Alternatively, the gaming device cabinet can include a slot which houses the support or ledge. A player can slide the support or ledge out of the slot to hold a drink or item and then slide the support or ledge back into the slot when finished playing at the gaming device. It should be appreciated that any suitable mechanical devices or set of devices can be used to connect a support or ledge of any suitable size and shape to the cabinet of the gaming device.

Container-Item Holder

The container-item holder of the present invention can be inserted into any embodiment of the gaming device as described above. For illustration purposes only, the container-item holder described below is described for use in the gaming device 10*a* illustrated in FIG. 1. In one embodiment illustrated in FIGS. 2, 3, 5, 6 and 7, the container-item holder 20 includes a container holding portion or container holder 26 which is connected to a item holding portion or item holder 28. The container holding portion 26 includes a tubular-shaped body or wall 30 having an upper end 30*a* and a lower end 30*b*. In one embodiment, the upper end 30*a* includes a flange which has a circumference greater than the circumference of the wall 30.

More specifically, In one embodiment, the container holding portion 26 includes a traversely extending upper lip or flange 32 attached to the upper end 30*a* of the wall 30 for supporting the container holding portion 26 within the bolster channel 16. The flange 32 secures the container-item holder 20 within channel 16 and prevents the container-item holder 20 from sliding through the bolster channel 16. Flange 32 has a circumference greater than the circumference of the channel 16. Consequently, when the container-item holder 20 is inserted into channel 16 of the bolster 14, the flange 32 engages the upper surface 22*a* of the bolster 14. The flange 32 supports the weight of the container and any items held by the container-item holder 20. In this embodiment, preferably flange 32 is cast or molded as part of the wall 30. However, it should be appreciated that flange 32 can be any suitable part welded, riveted or otherwise connected to the wall 30 which prevents the container-item holder 20 from sliding through the channel 16.

In alternative embodiments, instead of or in addition to relying on a flange, the wall 30 can screwably engage channel 16 or be press fit into channel 16. For a screwable engagement, the channel 16 can be threaded, and the upper end 30*a* of the container holding portion 26 can be threaded for screwing the container-item holder 20 into the channel 16. A substantial portion of the container-item holder 20 could then be placed in the channel 16 and the container-item holder 20 could then be screwed into channel 16 for a secure fit. For a press fit engagement, the wall 30 could be substantially equal to or slightly larger in diameter than the diameter of the channel 16. In one embodiment, the wall 30 could also be constructed from a deformable material which can be slightly compressed when the container holder is mounted in the channel 16. The two diameters being roughly equal in size can create a frictional engagement without deforming the container-item holder or the bolster or support. The press fit generates a frictional engagement which supports the weight of the container and items held by the container-item holder 20. It should be appreciated that other suitable notches or other mechanisms can be connected to the wall 30 which prevent the container-item holder 20 from sliding through channel 16.

In one alternative embodiment, the container holding portion has generally tapered walls. In this embodiment, the upper end of the container holding portion has a greater diameter than the lower end of the container holding portion. This tapering provides the support for the container-item holder in the bolster and prevents the container-item holder from sliding through the bolster.

In another alternative embodiment, an engaging portion, adapted to removably secure the container-item holder to the bolster, is connected to the container holding portion. The engaging portion can be comprised of tabs or hooks connected to the wall of the container holding portion or other suitable mechanisms for removably securing the container-item holder in the bolster.

As illustrated in FIG. 2, in one embodiment, the upper end 30*a* of the container holding portion's wall 30 is slanted so that when the container-item holder 20 is inserted into bolster 14, the upper end 30*a* is substantially flush with the upper surface 22*a* of the bolster even though the bolster is slanted. Accordingly, when the container-item holder 20 is inserted into the bolster 14, the container holding portion 26 does not protrude from the upper surface 22*a* of the bolster 14.

The lower end 30*b* of the container holding portion 26 includes a base 34 which supports cups, cans and other containers. The base 34 includes or defines a plurality of holes, cavities or drainage openings 36 which prevent spilled beverage from accumulating inside the container holding portion 26. As described below, base 34 defines an opening 38 for receiving the item holding portion 28.

In one embodiment, the item holding portion 28 is comprised of a hook 40. Hook 40 includes a relatively straight connecting portion 40*a* which extends through and into the opening in the base 34 of the container holding portion 28. The hook 40 also includes a securing portion 40*b* which holds items which are hung on the hook 40. The connecting portion 40*a* defines a circumferential slot or groove 42. Groove 42 is suitably sized to receive a retaining ring 44. Retaining ring 44 has an outer circumference which is greater than the circumference of the opening 38. A corresponding groove 42*a* is formed in the item holding portion 28 below the base 34 and is suitably sized to receive retaining ring 44*a*. Retaining ring 44*a* has an outer circumference which is greater than the circumference of the opening 38. The rings 44 and 44*a* co-act to limit the movement of the item holding portion 28. It should be appreciated that a retaining member or ring may be formed in the item holding portion 28 to prevent the upward movement of the holding portion 28.

To connect the hook 38 to the container holding portion 26, the connecting portion 38*a* of the hook 38 is inserted into and extended through the opening 40 of the base 34 of the container holding portion 26. The retaining ring 44 is, then mounted or slid into the groove 42 of the hook 28. The retaining ring 44*a* is then mounted or slid into the groove 42*a* of the hook 28. This type of fastener enables the hook 40 to freely rotate within the base 34 of the container holding portion 26.

It should be appreciated that other suitable fasteners could be used to connect the hook to the container holding portion. For example, a transversally extending hole can be formed through the hook's connecting portion 40*a*, and a pin can be removably inserted through this hole. In another example, the hook's connecting portion 40*a* can be threaded to receive a nut, and a rotatable washer can be placed between the nut and the base 34 of the container holding portion.

In one alternative embodiment, the connecting portion of the hook is threaded. The hole in the base of the container holding portion is also threaded. The item holding portion is connected to the base by screwing the hook into the base.

It should also be appreciated that the item holding portion, whether a hook or other mechanism, can be fastened to or connected to the container holding portion in any suitable manner, such as through the use of welding, adhesives or other suitable joining methods. Also, it should be appreciated that in alternative embodiments the item holding portion can be integrally formed with the container holding portion in one unit, through molding, casting or other suitable material formation techniques.

The container-item holder of the present invention can be constructed of any suitable material including, but not limited to, urethane, polyvinyl chloride, polyvinyl acetate and aluminum. It is preferable, however, that the container-item holder be constructed of a plastic or metal such as aluminum.

Figure 8:
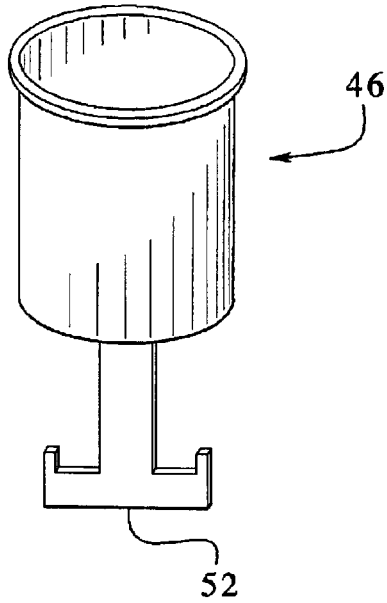
FIG. 8 is a side elevation view of an alternative embodiment of the container-item holder of the present invention.
Figure 9:
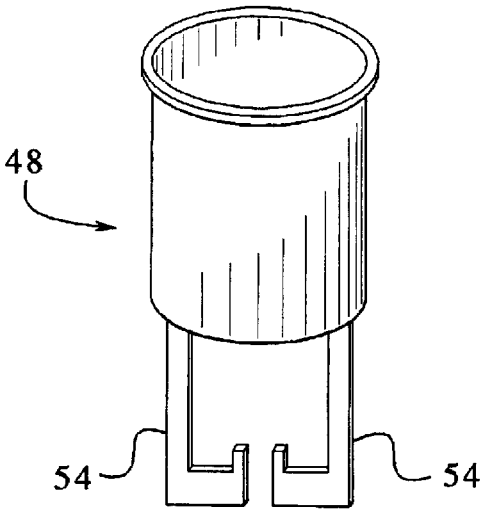
FIG. 9 is a side elevation view of another alternative embodiment of the container-item holder of the present invention.
Figure 10:
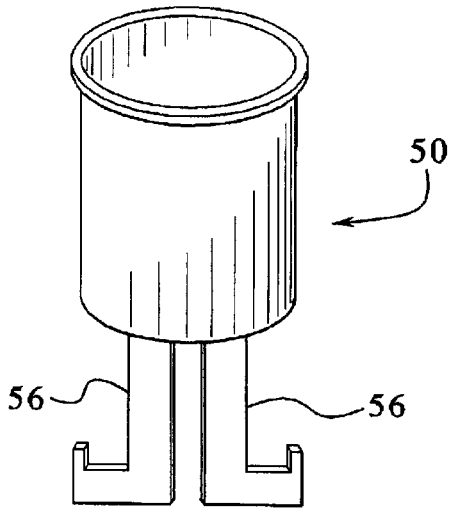
FIG. 10 is a side elevation view of another alternative embodiment of the container-item holder of the present invention.

The container-item holder of the present invention can be comprised of various shapes and sizes, several examples of which are illustrated in the FIGS. 8, 9 and 10. FIGS. 8, 9 and 10 illustrate container-item holders 46, 48 and 50 including various shaped item holding portions 52, 54 and 56, respectively. Item holding portion 52 includes a single member having two upturned ends facing away from each other. Item holding portion 54 includes two separate members which have upturned ends facing each other. Item holding portion 56 includes two separate members which have upturned ends facing away from each other.

Figure 6:
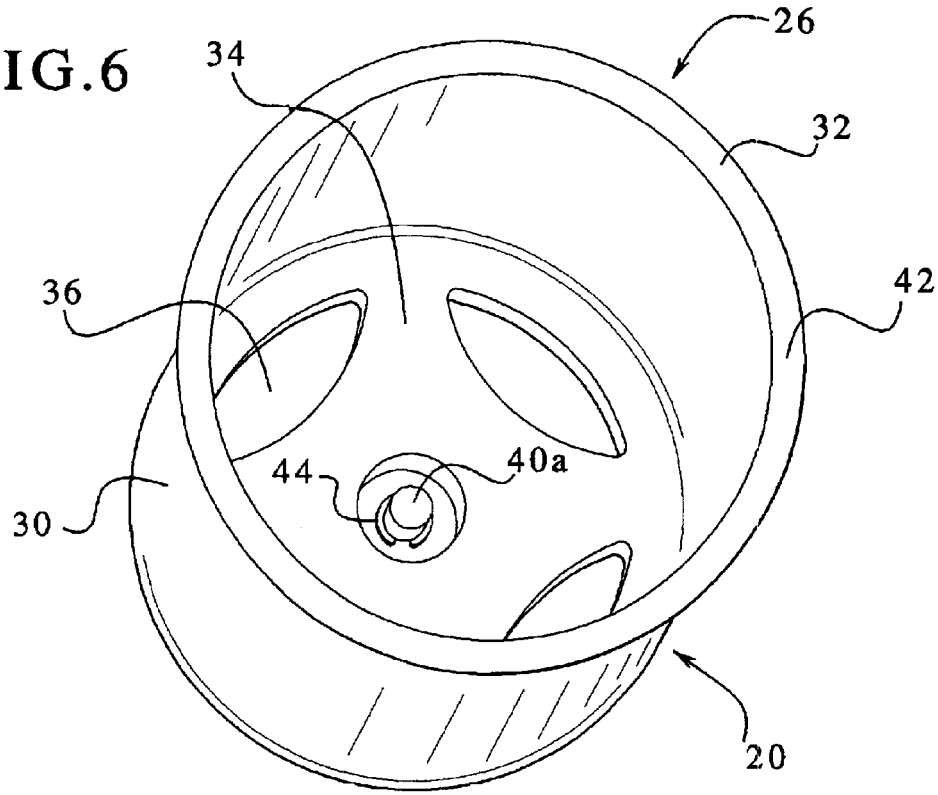
FIG. 6 is a top perspective view of the container holder of container-item holder of FIG. 1.
Figure 7:
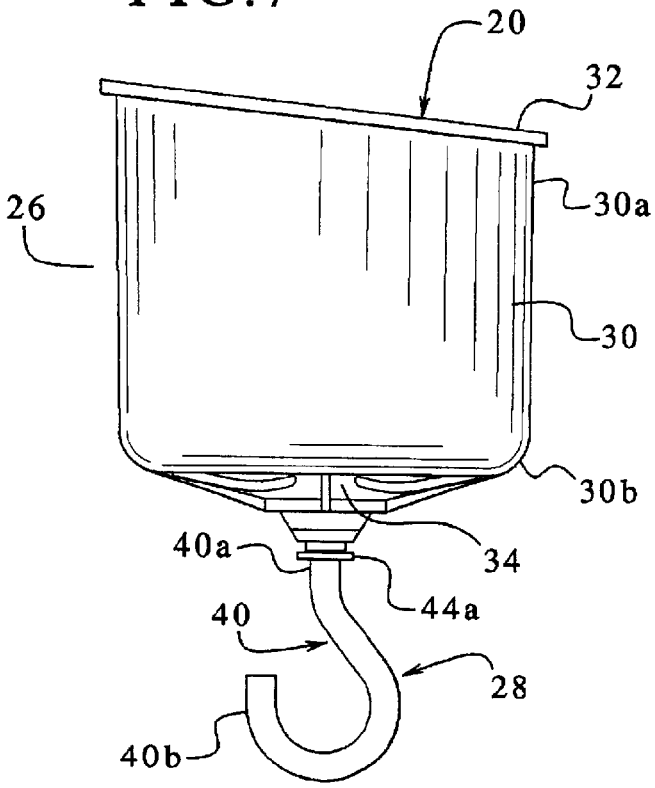
FIG. 7 is a side elevation view of the container-item holder of FIG. 1.

It should be appreciated that certain embodiments of the item holding portion, such as that illustrated in FIG. 6, may provide specific protection or deterrence against theft of personal items. In one embodiment, the item holding portion includes a spring-activated clip. A player can open the clip, hang a personal item on the hook and close the clip. Such an item holding portion provides additional security measures for personal items. It should be appreciated that the item holding portion can include any mechanical or electrical components for notifying a player that the player's personal item is being pulled or moved in a particular manner or with a predetermined force. It should also be appreciated that the removable container-item holder of the present invention can be used to hold: (i) any container of beverage, coins, tokens or any other objects; and (ii) any personal item or other item, including, but not limited to, bags.

The present invention includes a gaming device which is adapted to receive a removable container-item holder which can hold a beverage or token container and one or more personal items, such as a purse, coat, hat or umbrella. The present invention also includes the container-item holder specially adapted for insertion into such a gaming device. This type of gaming device and container-item holder provides players with increased convenience, comfort and ease of mind when playing games.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A gaming device comprising:

a cabinet including a bolster mounted to the cabinet and a combined container-item holder attached to said bolster, said bolster defining a channel for receiving the container-item holder, and said container-item holder adapted to simultaneously hold a container in or above the bolster and a personal item below the bolster, said container-item holder including:

a container holder mounted in the channel, said container holder including a base and a body extending upwardly from the base, said base and body defining a chamber adapted to receive and hold said container; and an item holder including a connecting member connected to the base of the container holder and a securing member connected to the connecting member.

2. The gaming device of claim 1, wherein the container holder includes a flange connected to the body, wherein the flange has a circumference greater than a circumference of the channel in the bolster.

3. The gaming device of claim 1, wherein the securing member includes a hook.

4. The gaming device of claim 1, wherein the base defines at least one opening which enables fluid to drain through the base.

5. The gaming device of claim 1, wherein the securing member includes means for inhibiting an item from being easily removed from the item holder.

6. The gaming device of claim 1, wherein the connecting member is rotatably connected to the base.

7. The gaming device of claim 1, wherein the channel is cylindrical.

8. The gaming device of claim 1, wherein the channel extends substantially vertically through the entire bolster.

9. A gaming device including a cabinet and a bolster connected to the cabinet, wherein the bolster includes a substantially vertically extending channel, said gaming device comprising:

a combined container-item holder including:

a container holder mounted in the channel, said container holder having a bottom surface, a body defining at least one opening to enable fluid to drain from the container holder and a flange connected to the body, said flange having a circumference greater than the circumference of the channel; and at least one hook projecting from the bottom surface of the container holder, said hook including a relatively straight connecting portion and a securing portion connected to the connecting portion, said securing portion enabling a player to securely and removably connect at least one item to the hook, wherein said securing portion includes an inhibiting device for inhibiting the item from being easily removed from the item holder.

10. The gaming device of claim 9, wherein the bottom surface defines at least one opening which enables fluid to drain from the chamber.

11. The gaming device of the claim 9, wherein the bottom surface and the body define a chamber for receiving and holding a container.

12. The gaming device of claim 9, wherein the inhibiting device includes a spring activated clip.

* * * * *